United States Patent [19]

Castilla

[11] Patent Number: 4,543,898

[45] Date of Patent: Oct. 1, 1985

[54] TWO HULLED MOTOR TO SAIL CONVERTIBLE BOAT

[76] Inventor: Antonio J. Castilla, Rte. 1, 18A, Rose Garden Estates, McKinney, Tex. 75069

[21] Appl. No.: 540,536

[22] Filed: Oct. 11, 1983

[51] Int. Cl.[4] ..... B63B 1/12

[52] U.S. Cl. ..... 114/39; 114/61; 114/163; 440/62

[58] Field of Search ..... 114/18, 19, 39, 61, 114/163, 270; 440/62

[56] References Cited

U.S. PATENT DOCUMENTS

| | | | |
|---|---|---|---|
| 2,775,218 | 12/1956 | Kapusnyk | 114/61 |
| 3,135,130 | 6/1964 | Bentley | 440/62 X |
| 3,552,349 | 1/1971 | Snow | 114/270 |
| 3,646,905 | 3/1972 | Martinmaas | 114/270 |
| 3,656,445 | 4/1972 | Padwick | 114/61 |
| 3,871,316 | 3/1975 | Woodrich | 114/39 X |
| 4,027,614 | 6/1977 | Jones | 114/163 |
| 4,106,426 | 8/1978 | Wertz | 440/62 |

*Primary Examiner*—Sherman D. Basinger
*Attorney, Agent, or Firm*—Warren H. Kintzinger

[57] ABSTRACT

A recreational twin hulled boat with the hulls interconnected by hull spacing structure with the boat convertible between outboard motor drive and sail drive. The hull spacing structure is also the mount for an outboard motor when the boat is converted for outboard motor drive with the hull spacing structure also mounting a fuel tank, operator saddle and some of the steering mechanism that includes two steering cables connected to opposite ends of a bell crank gear driven from a gear interconnect with steering handlebars. The steering cables for the motor driven conversion extend back and around idler pulleys to ultimately idler pulleys on each hull and then to connection to a rudder transverse rod interconnecting the rudders at the rear of each hull. This steering system turns the rudders in unison around their pivotal mountings opposite to the turning direction of the steering handle bars with the outboard motor locked in place so as not to pivot but to only provide thrust. In the sail conversion a tiller and rod interconnect steering system is used connected to the rudders that still employ the rudder transverse rod interconnecting the rudders at the rear of each hull. Hull interconnect transverse rods have a mounting connection with mount pads on each hull that also serve as the mounting pads for the hull spacing structure in the outboard motor driven boat conversion.

12 Claims, 6 Drawing Figures

TWO HULLED MOTOR TO SAIL CONVERTIBLE BOAT

BACKGROUND OF THE INVENTION

This invention relates generally to aquatic sport devices and, more particularly, to a two hulled motor to sail convertible recreation boat adapted to be ridden by one or more persons in the motor conversion in the manner of a motorcycle.

Bicycle-like motorized aquatic sport boats have been known for some time with many of them being single hull sport boat structures with built-in power plants. These sport boats are generally designed such that the operator will sit astride the motor compartment or stand forward or aft of the motor. Some of these sport boats perform, in higher speed ranges, like a water ski, and some others resemble a motorcycle in that they have a forward pontoon or hull directionally steerable through a handlebar or wheel driving system, and a rear hull supporting the operator and the motor. Some of these sport boats require skilled operators since they tend to capsize easily, with some excessively heavy and hard to control. Furthermore, few if any of these preexisting sport boats provide for conversion to sail drive.

It is, therefore, a principal object of this invention to provide a lightweight, easily transportable, motorized sport boat readily convertible to sail drive.

Another object is to provide such a sport boat that is quite stable in both the motorized and sail drive conversions thereof.

A further object is to provide such a sport boat powered, in the motorized conversion, by a standard outboard motor.

Still another object is to provide such a sport boat with two substantially duplicate hulls steering direction controlled by twin rudders one at the rear of each hull in both the motor and sail driven conversions.

Features of the invention useful in achieving the above objects include, in a two hulled motor to sail convertible sport boat, a pair of twin lightweight molded plastic hulls filled through much of the displacement volume thereof with foamed floatation plastic material other than bulkheads structural longitudinal members and stowage compartments therein. Two mounting pads are provided on the top of each hull one adjacent to but forward of the longitudinal mid-section of the hull and the other mounting pad about a quarter of the length of the hull forward from the rear of the hull. A motorcycle like seat handlebar and motor mount structure equipped with four mount pads that mate and fasten to the mount pads of the hulls constitutes a spacing structure for the two hulls and mounts a non-turning outboard motor in the motor driven conversion of the sport boat. Two transverse hull spacing rods with mounting pads on opposite ends are connected to the hull pads in the sail driven conversion with the forward transverse hull spacing rod mounting a sail mast, and passenger support structure is extended between the twin hulls. Twin rudders, one mounted on the rear of each hull, are interconnected by a rudder transverse rod with the steering system thereby turning the rudder in unison around their pivotal mountings in both the motor driven and in the sail driven conversions. In the motor driven conversion the steering mechanism includes two steering cables connected to opposite ends of a bell crank gear driven from a gear interconnect with steering handlebars. The steering cables for the motor driven conversion extend back and around idler pulleys to ultimately idler pulleys on each hull and then to connection to the rudder transverse rod interconnecting the rudders at the rear of each hull. In the sail conversion a tiller and rod interconnect steering system is used connected to the rudders that still employ the rudder transverse rod interconnecting the rudders at the rear of each hull.

A specific embodiment representing what is presently regarded as the best mode of carrying out the invention is illustrated in the accompanying drawing.

DESCRIPTION OF THE PREFERRED EMBODIMENT

Figure 1:
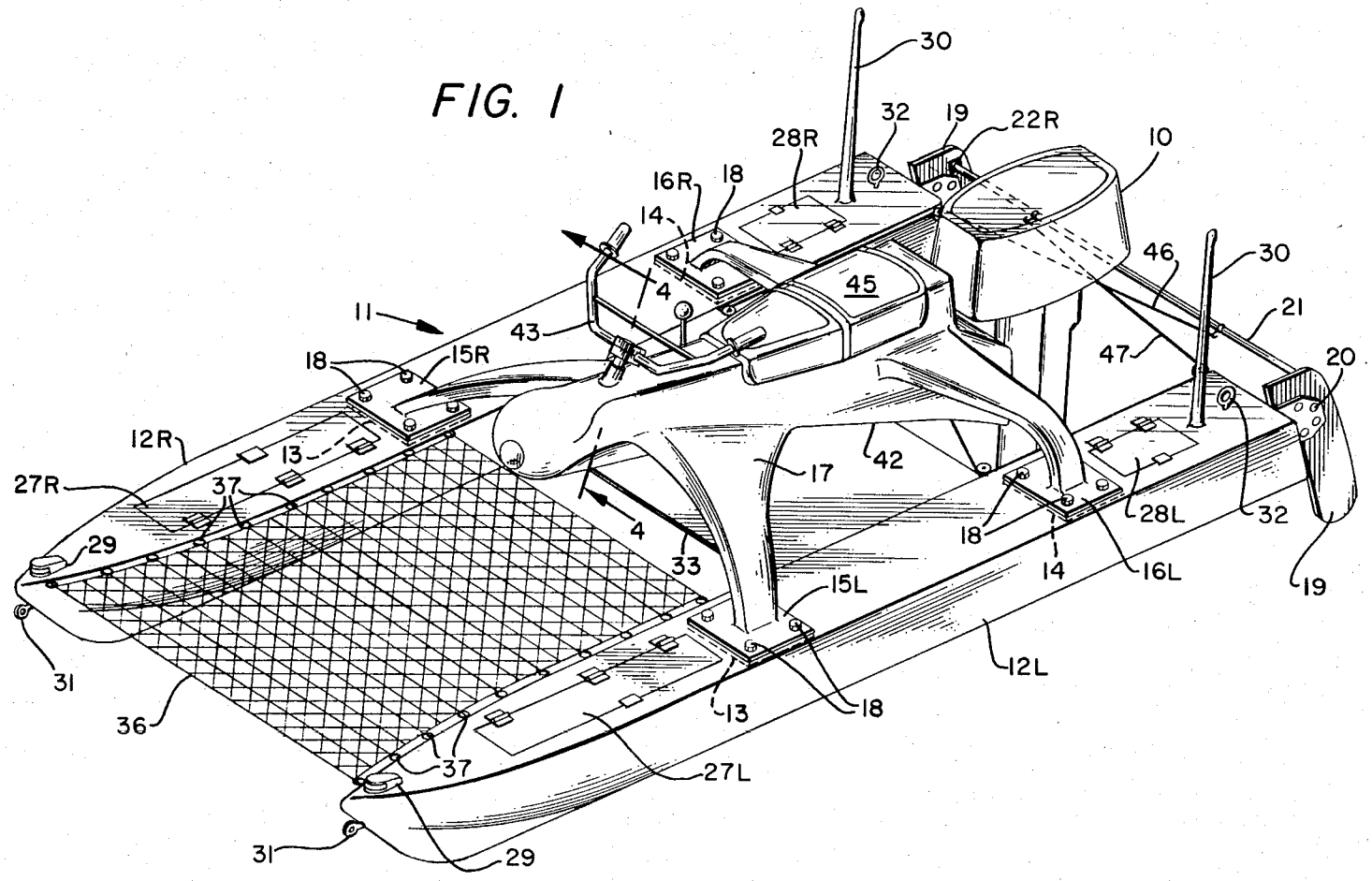
FIG. 1 represents a perspective view of a twin float outboard motor driven conversion of the sport boat.
Figure 2:
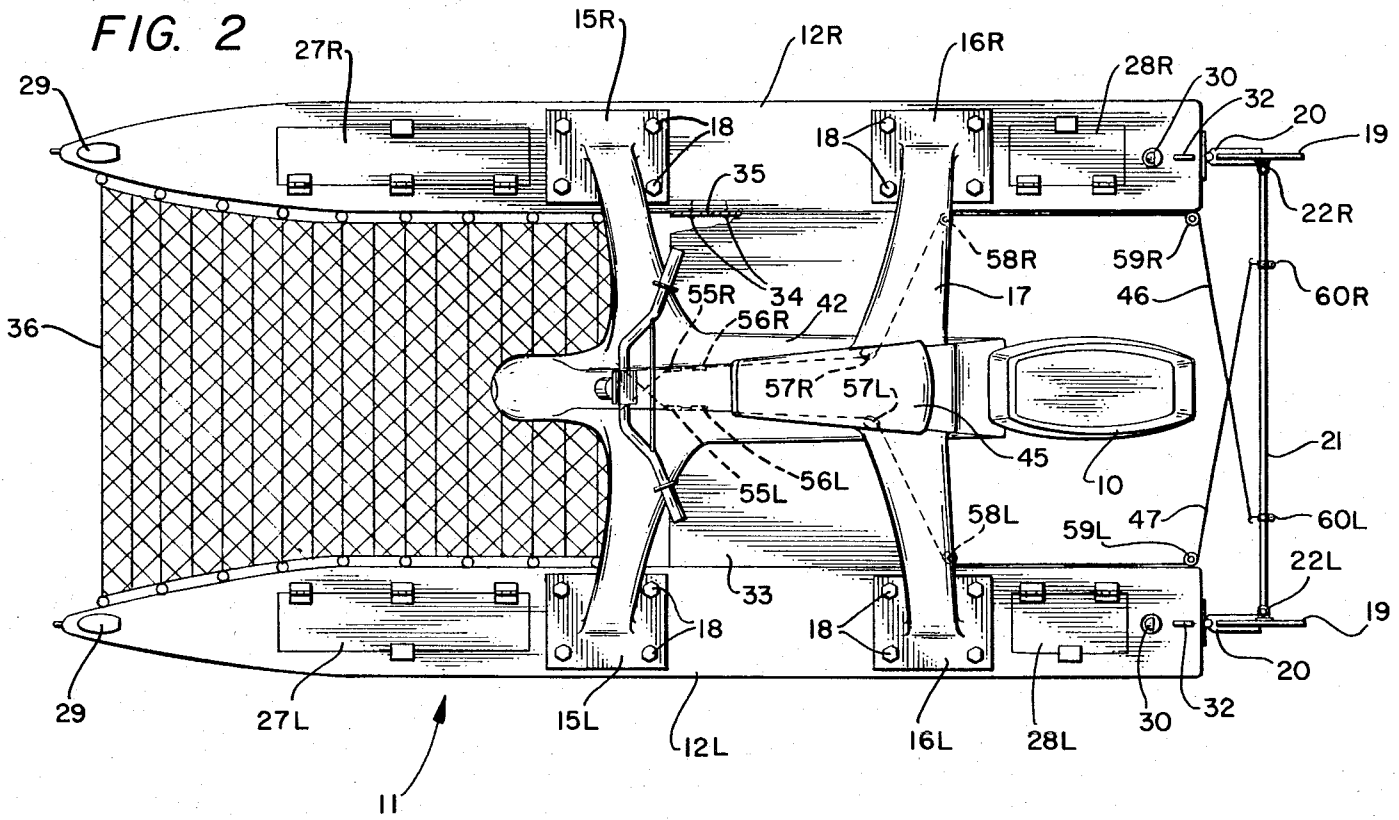
FIG. 2, a partial cut away top elevation of the motor driven sport boat of FIG. 1.
Figure 3:
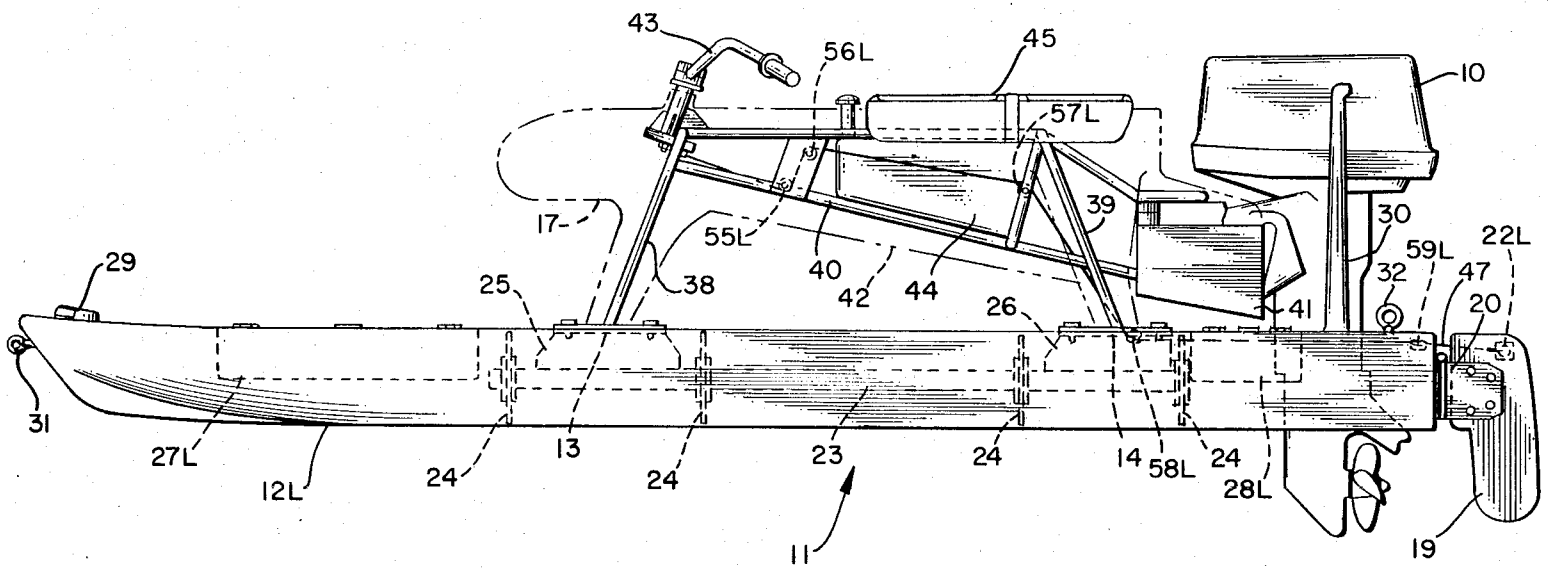
FIG. 3, a side elevation view of the motor driven sport boat of FIGS. 1 and 2.
Figure 4:
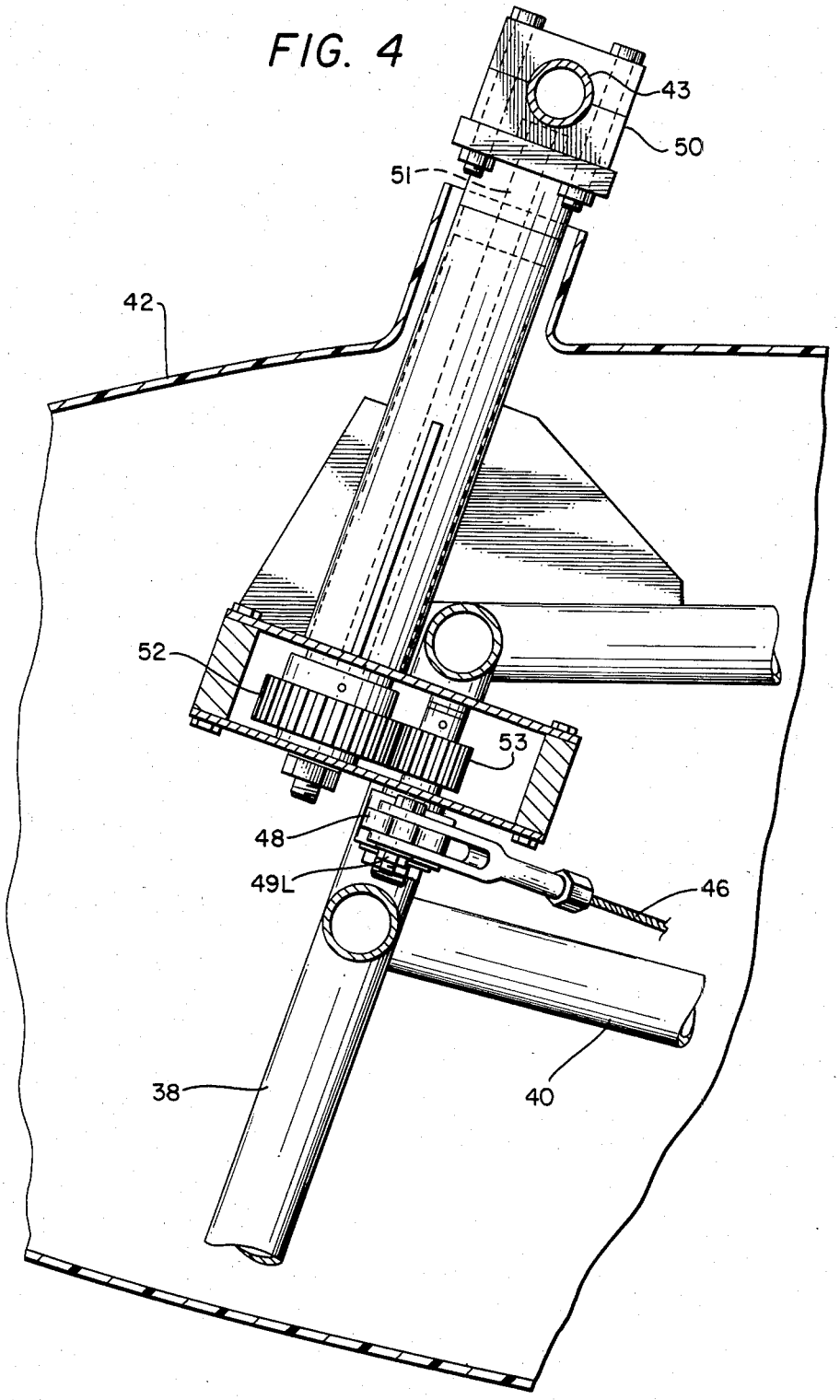
FIG. 4, a partial enlarged side elevation view showing detail of the handlebar steering column steering cable bellcrank gear interconnect structure of the motor driven boat of FIGS. 1–3.

Referring to the drawings:

The outboard motor 10 driven boat 11 of FIGS. 1–5 is shown to have twin pontoon-like hulls 12L and 12R with front and rear mounting pads 13 and 14, respectively, to which mating mount pads 15L and 15R and 16L and 16R of the motor 10 mounting hull spacing structure 17 are fastened as by bolts 18. A rudder 19 is mounted at the rear of each hull 12L and 12R by a pivot structure 20 that permits pivoting steering articulation of the rudders 19 and also pivotal raising of the rudders 19 from the lowered operational state of FIG. 1 to a raised stowed state such as indicated with the sail conversion of the boat in FIG. 6. A rudder 19 interconnect transverse rod 21 has pivotal connections 22L and 22R with respective inside sides of each rudder 19 with the rod 21 a steering actuating rod for the rudders 19. The twin hulls 12L and 12R are molded to be symetrical so one molded hull shape can be used for both hulls with each hull enclosing a longitudinal structural frame member 23 that extends lengthwise through the hull for a substantial length as shown. A number of bulkhead like structures 24, in this instance four, are fixed in position at various points along the length of the frame member 23 providing bracing and rigidity within each hull. Structural interconnect sections 25 and 26 support the front and rear pads 13 and 14 respectively in each of the hulls 12L and 12R that are also provided with forward storage compartments 27L and 27R and rear storage compartments 28L and 28R. The hulls 12L and 12R are also fitted with forward running lights 29, particularly for the motorized conversion, and rear running light towers 30. Dock tie eye bolts 31 are provided on the prow of hulls 12L and 12R and tie eye bolts 32 are provided on the top of the rear of hulls 12L and 12R. A platform or deck 33 is mountable extending between the two hulls 12L and 12R in the longitudinal mid section of both the motorized boat conversion of FIG. 1 and the sail driven boat conversion of FIG. 6, and is fastened to the hulls by screws 34 extended through side flanges 35. A support net 36 is stretch mounted between the two hulls forward from the mid section of both embodiments with closely spaced hull connectors 37 on both hulls.

Figure 5:
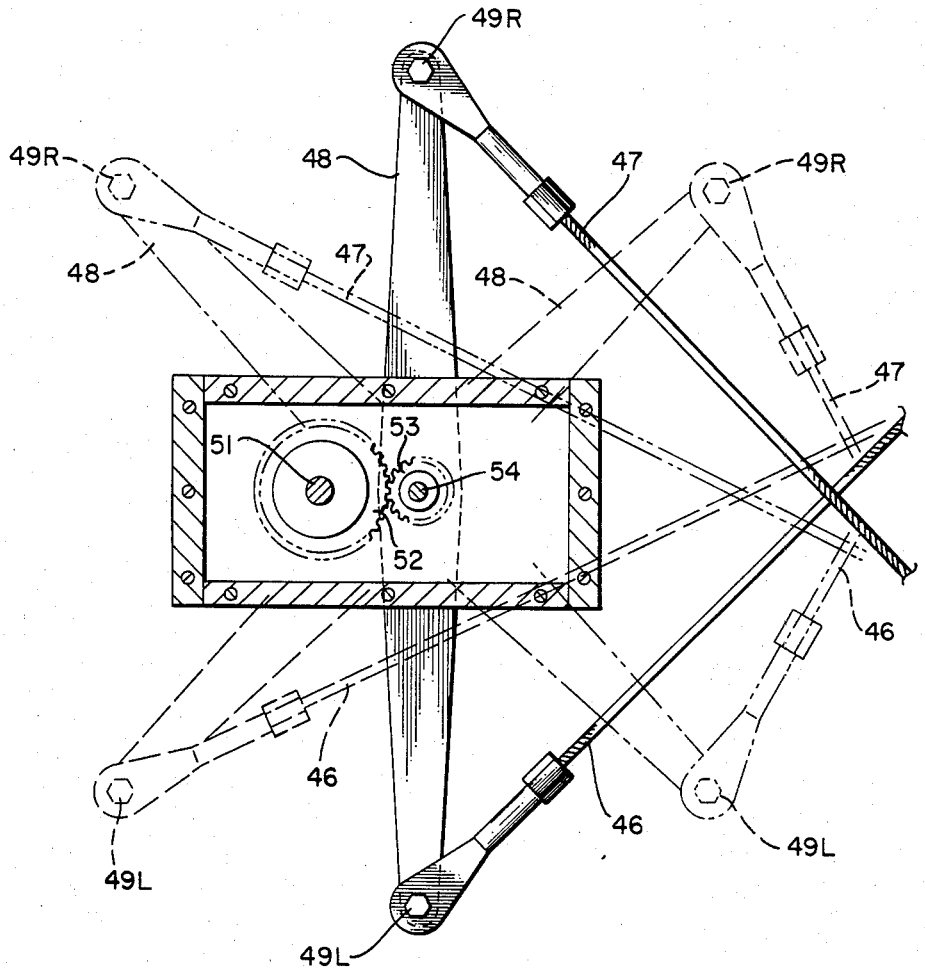
FIG. 5, a partial enlarged top plan view showing detail of the handlebar steering column steering cable bellcrank gear interconnect structure of the motor driven sport boat of FIGS. 1–3.

The motor 10 mounting hull spacing structure 17 includes fore and aft arcuate frame members 38 and 39 with a longitudinal frame structure 40 interconnecting the arcuate frame members 38 and 39 and extended to motor mount 41. The fore and aft arcuate frame members 38 and 39 and longitudinal frame structure 40 are enclosed with a housing 42 that may be molded plastic housing in the hull spacing structure 17 mounting thereon steering handlebars 43, a fuel tank 44, and a user rider saddle 45 in addition to motor mount 41 for the motor 10. The steering mechanism interconnect between steering handlebars 43 and the rudder steering transverse rod 21 includes two steering cables 46 and 47 installed in mirror image fashion connected to opposite ends of a bell crank 48, as shown in FIG. 5, by pivot connections 49L and 49R. The steering handlebars 43 are mounted by clamp 50 on the top of a steering column rotatably mounted shaft 51 that has a steering sun gear 52 mounted on the bottom thereof for rotation therewith as induced by user turning of handlebars 43. A spur gear 53 mounted to be driven by sun gear 52, is connected via its mounting shaft 54 for driving bell crank 48 in the opposite direction of rotation to rotation of the handlebars 48 and the sun gear 52. The two steering cables 46 and 47 extending from bell crank 48 opposite end connections transversly criss-cross to pass pulleys 55L and 55R extend up to and over pulleys 56L and 56R back to and over pulleys 57L and 57R and down along opposite sides of aft frame member 39 to hull mounted pulleys 58L and 58R. The cables 46 and 47 pass over pulleys 58L and 58R and extend back to and around pulleys 59L and 59R, mounted to the inside rear of the respective twin hulls 12L and 12R, from which they extend in criss-cross fashion to end connection with hook brackets 60L and 60R mounted on steering transverse rod 21. It should be noted that slack in steering cables 46 and 47 may be taken up by loosening hook brackets 60L and 60R and moving them on steering transverse rod 21 and retightening them or by turnbuckle like adjustment of the cable end connections to pivot connections 49L and 49R. This steering system turns the rudders in unison around their pivotal mountings opposite to the turning direction of the steering handlebars, for example, with the operator turning the handlebars to the right (clockwise) the rudders are turned counter clockwise to turn the boat to the right. The outboard motor 10, mounted on the rear of motor 41 is locked in place so as not to pivot and only provide driving thrust.

Figure 6:
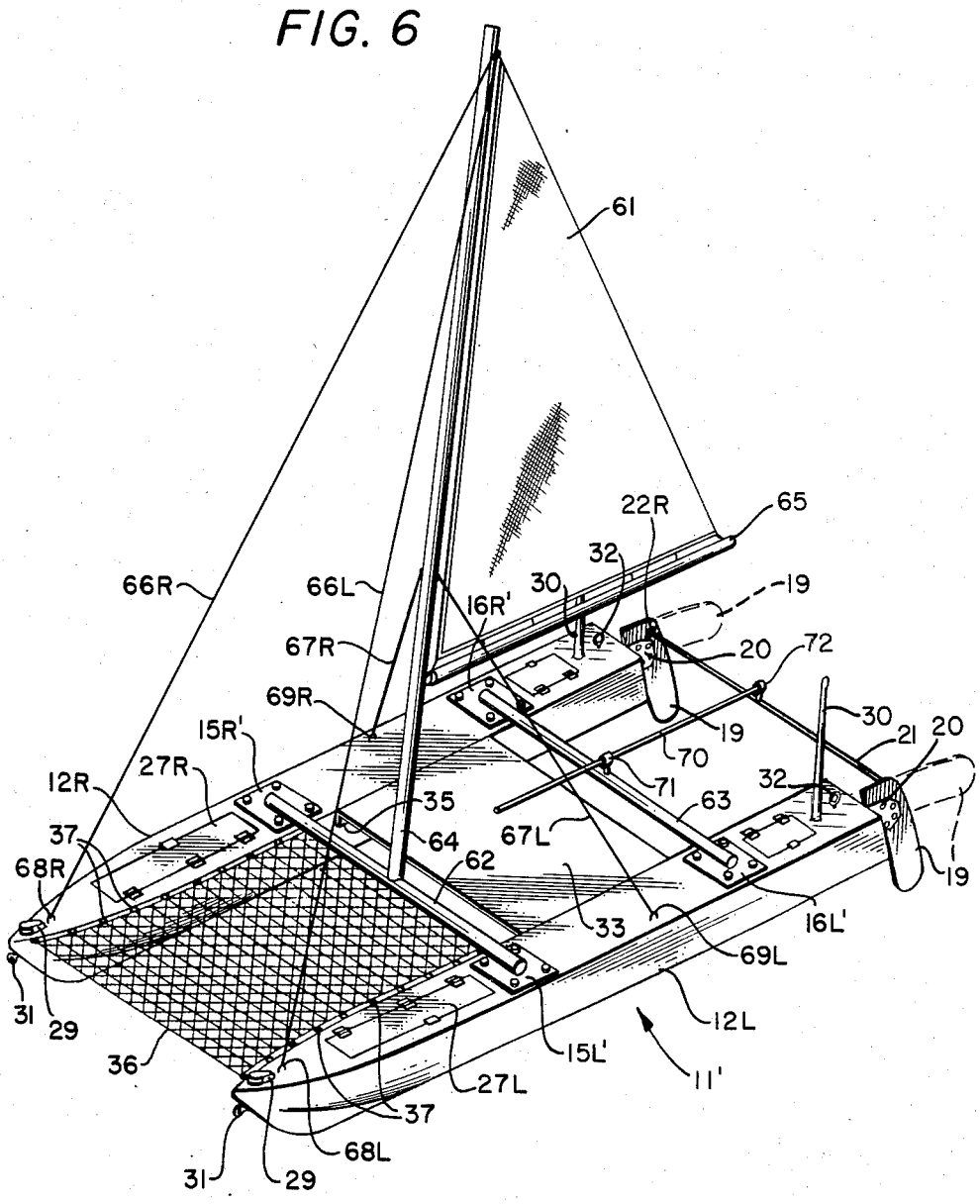
FIG. 6, a perspective view of the twin float sail driven conversion of the sport boat.

Referring now to the sail 61 driven sport boat 11' conversion of FIG. 6 the same twin hulls 12L and 12R are used with same deck plate 33 and support net 36 stretch mounted therebetween. Two transverse hull spacing rods 62 and 63 are used in this boat conversion with end mount pads 15L' and 15R' and 16L' and 16R' bolted to respective hull front and rear mounting pads 13 and 14. A sail mast 64 is mounted on and extends vertically from the center of hull spacing rod 62 to mount sail 61 and its boom 65. Mast rigging cables 66L and 66R, and 67L and 67R support the mast in the erected state with cables 66L and 67L extending from the mast 64 to cable end fastening fittings 68L and 69L on hull 12L, and the cables 66R and 67R extending from the mast 64 to cable and fastening fittings 68R and 69R on hull 12R. Tiller rod 70 extends through pivot mount 71, mounted on the top of hull spacing rod 63, for turning movement of the tiller 70 transmitted to pivot mount 72 bolted in place on the middle of transverse rod 21 to implement rudder 19 turning as controlled by the tiller rod 70.

Thus, there is hereby provided a two hulled boat convertable between motor driven and sail driven conversions. The hulls are twin hulls with decking extended therebetween in both versions and with support netting extended therebetween at the front of the boat. There are two rudders one at the rear of each hull with the rudders controlled in unison via a transverse rudder interconnect rod as part of the steering system in both versions. The hull spacing structure is also the mount for an outboard motor when the boat is converted for outboard motor drive with the hull spacing structure also mounting a fuel tank, operator saddle and some of the steering mechanism that includes two steering cables connected to opposite ends of a bell crank gear driven from a gear interconnect with steering handlebars. The steering cables for the motor driven conversion extend back and around idler pulleys to ultimately idler pulleys on each hull and then to connection to a rudder transverse rod interconnecting the rudders at the rear of each hull. This steering system turns the rudders in unison around their pivotal mountings opposite to the turning direction of the steering handle bars with the outboard motor locked in places so as not to pivot but to only provide thrust. In the sail conversion a tiller and rod interconnect steering system is used connected to the rudders that still employ the rudder tranverse rod interconnecting the rudders at the rear of each hull. Hull interconnect transverse rods have a mounting connection with mount pads on each hull that also serve as the mounting pads for the hull spacing structure in the outboard motor driven boat conversion.

Whereas this invention has been described with respect to several embodiments thereof, it should be realized that various changes may be made without departure from the essential contributions to the art made by the teachings hereof.

I claim:

1. A sport boat convertible between outboard motor drive and sail drive with spaced hulls comprising: twin hulls each having top mounting pad means; hull spacing structure means with mounting pad means on each side for mounting connection with said top mounting pad means on each of said twin hull means whereby the twin hulls are held generally in spaced relation when the mounting pad means of said hull spacing structure means are mounting connected to respective top mounting pad means of the said twin hulls; and drive propulsion means mounted on said hull spacing structure means; a boat steering rudder is pivotally mounted on the rear of each of said twin hulls; and a steering transverse rod interconnects the rudders to turn rudders in unison around their pivotal mountings with transverse steering movement imparted to said steering transverse rod; wherein in the outboard motor drive conversion said hull spacing structure means is a passenger user mount and outboard motor mount having fore and aft arcuate frame sections spanning the space between said twin hulls and terminating with a mounting pad at opposite ends of said fore and aft arcuate frame sections as said mounting pad means; and each hull of said twin hulls has a fore top mounting pad and an aft mounting pad as said top mounting means longitudinally spaced to match the longitudinal spacing of said fore and aft arcuate frame section mounting pads for mounting connection thereto; and wherein in the sail drive conversion said hull spacing structure means includes at least two straight transverse members a fore and aft transverse member with mount pads on opposite ends of said fore and aft transverse members that mount, respectively, on said fore top mounting pad and said aft mounting pad of said top mounting pad means on said twin hulls in the sail drive conversion; and wherein a sail mast is mounted on and extends vertically from said fore transverse member; and wherein said hull spacing structure means in the outboard motor drive conversion includes a longitudinal frame structure interconnecting said fore and aft arcuate frame members and extended to the rear with a motor mount for mounting an outboard motor; and wherein said fore and aft arcuate frame members and said longitudinal frame structure are enclosed in a molded plastic housing.

2. The sport boat with spaced hulls of claim 1, wherein a deck platform is mounted on said spaced hulls spans the space between said hulls in the longitudinal mid region of the boat.

3. The sport boat with spaced hulls of claim 2, wherein a support net is stretch mounted between the two hulls forward from said deck platform.

4. The sport boat with spaced hulls of claim 1, wherein said hull spacing structure means includes steering means connected to said steering transverse rod interconnecting said rudders.

5. The sport boat with spaced hulls of claim 4, wherein in the outboard motor drive conversion said steering means includes steering handlebars having a sun gear and spur gear interconnect to a bell crank for driving the bell crank in the opposite direction to the direction of rotation of the handlebars and the sun gear connected to the handlebars; two steering cables connected to opposite ends of the ball crank criss crossed to pulley means on said hull spacing structure and extended to hull mounted pulleys and therefrom to connection with said transverse rod to effectuate turning of said rudders opposite to the turning direction of the steering handlebars.

6. The sport boat with spaced hulls of claim 5, wherein the connection of said steering cables to said steering transverse rod is via brackets that may be position adjusted on said steering transverse rod to take up slack in said steering cables.

7. The sport boat with spaced hulls of claim 5, wherein said hull spacing structure mounts said steering handlebars and a user rider saddle at the top thereof, a fuel tank within, and the outboard motor on said motor mount at the rear.

8. The sport boat with spaced hulls of claim 7, wherein said outboard motor is locked in place not to pivot turn and provide aligned driving thrust.

9. The sport boat with spaced hulls of claim 1, wherein in the sail drive conversion said fore and aft transverse members are tubular rods.

10. The sport boat with spaced hulls of claim 9, wherein said sail mast is mounted to extend vertically from the transverse center of said fore transverse tubular rod; and said sail mast mounts a sail as said drive propulsive means.

11. The sport boat with spaced hulls of claim 10, wherein a tiller is pivotally mounted on said aft transverse tubular rod and extends to a pivotal connection with said steering transverse rod.

12. The sport boat with spaced hulls of claim 11, wherein said tiller is pivotally mounted above the center of said aft transverse tubular rod; and the pivotal connection with said steering transverse rod is at the transverse center of said steering transverse rod.

* * * * *